US012377937B2

(12) United States Patent
Bangslund et al.

(10) Patent No.: US 12,377,937 B2
(45) Date of Patent: Aug. 5, 2025

(54) TOWING STAPLE AND HULL FOR A VESSEL FOR TOWING

(71) Applicant: SVITZER A/S, Copenhagen K (DK)

(72) Inventors: Thomas Bangslund, Holbæk (DK); Esben Grundtvig, Copenhagen S (DK); Marijan Mustac, Copenhagen Ø (DK)

(73) Assignee: SVITZER A/S, Copenhagen K (DK)

( * ) Notice: Subject to any disclaimer, the term of this patent is extended or adjusted under 35 U.S.C. 154(b) by 521 days.

(21) Appl. No.: 17/796,812

(22) PCT Filed: Feb. 2, 2021

(86) PCT No.: PCT/EP2021/052431
§ 371 (c)(1),
(2) Date: Aug. 1, 2022

(87) PCT Pub. No.: WO2021/156252
PCT Pub. Date: Aug. 12, 2021

(65) Prior Publication Data

US 2023/0046831 A1 Feb. 16, 2023

(30) Foreign Application Priority Data

Feb. 3, 2020 (DK) ..... PA202070065

(51) Int. Cl.
*B63B 21/56* (2006.01)
*B63B 21/04* (2006.01)
*B63B 35/68* (2006.01)

(52) U.S. Cl.
CPC ..... *B63B 21/56* (2013.01); *B63B 21/04* (2013.01); *B63B 35/68* (2013.01)

(58) Field of Classification Search
CPC ..... B63B 21/00; B63B 21/04; B63B 21/10; B63B 21/20; B63B 21/56;
(Continued)

(56) References Cited

U.S. PATENT DOCUMENTS 3,347,526 A 10/1967 Cymmer et al.
5,609,120 A 3/1997 Eronen
(Continued)

FOREIGN PATENT DOCUMENTS

CN 1115297 A 1/1996
CN 104619585 A 5/2015
(Continued)

OTHER PUBLICATIONS

International Search Report and Written Opinion dated Apr. 30, 2021 for PCT International Application No. PCT/EP2021/052431.

*Primary Examiner* — Daniel V Venne
(74) *Attorney, Agent, or Firm* — EIP US LLP

(57) ABSTRACT

A hull for a vessel for towing is disclosed, comprising a deck and a towing staple for guiding a towing line. The towing staple comprises a guiding element having a symmetrical extension in a first plane parallel to the deck, wherein the guiding element comprises a first and a second mounting section mounting the guiding element to the hull. The first and second mounting sections are connected by means of a main section of the guiding element. The guiding element comprises a towing line guiding surface located on a bottom side of the main section facing the deck, the towing line guiding surface being configured to, during a towing procedure, slidably contact the towing line, such that the towing line can freely move along a periphery of the main section in the first plane while being restricted in movement by the main section in a direction perpendicular to the first plane. The towing staple further comprises a support element, wherein the support element is arranged on a top side of the main section and extends at an angle to the first plane from the top side of the guiding element to a second plane perpendicular to the first plane and extending through the first and second mounting sections.

24 Claims, 4 Drawing Sheets

(58) Field of Classification Search
CPC . B63B 2021/566; B63B 21/58; B63B 21/663; B63B 2021/666; B63B 35/66; B63B 35/68; Y02T 70/10
USPC ..... 114/242, 249, 253, 254
See application file for complete search history.

(56) References Cited

U.S. PATENT DOCUMENTS

| | | | |
|---|---|---|---|
| 6,698,374 | B1 | 3/2004 | Van Der Laan |
| 2014/0326170 | A1 | 11/2014 | Borel |

FOREIGN PATENT DOCUMENTS

| | | | | |
|---|---|---|---|---|
| EP | 0672581 | A1 | 9/1995 | |
| EP | 0672582 | A1 | 9/1995 | |
| ES | 2541955 | A1 | 7/2015 | |
| JP | S5551684 | A | 4/1980 | |
| JP | S6116995 | U | 1/1986 | |
| NL | 2003746 | C2 | 5/2011 | |
| RU | 11531 | U1 * | 10/1999 | ..... B63B 21/56 |
| WO | 0130650 | A1 | 5/2001 | |
| WO | 2006049496 | A1 | 5/2006 | |
| WO | 2011139154 | A2 | 11/2011 | |
| WO | 2015014886 | A1 | 2/2015 | |

* cited by examiner

TOWING STAPLE AND HULL FOR A VESSEL FOR TOWING

CROSS-REFERENCE TO RELATED APPLICATIONS

This application is a 371 of International Application No. PCT/EP2021/052431, filed Feb. 2, 2021, which claims priority to Danish Application No. PA202070065, filed Feb. 3, 2020 under 35 U.S.C. § 119(a). Each of the above-referenced patent applications is incorporated by reference in its entirety.

BACKGROUND

The present disclosure pertains to the field of towage of vessels. The present disclosure relates to a towing staple for a hull of a vessel for towing and a hull for a vessel for towing comprising the towing staple.

A vessel for towing, such as a tugboat or tug, is a secondary boat that is used for maneuvering other, typically larger, vessels by pushing or pulling them either by direct contact or by means of a tow line. Tugs typically move vessels that either are restricted in their ability to maneuver on their own, such as ships in a crowded harbor or a narrow canal, or vessels that cannot move by themselves, such as barges, disabled ships, log rafts, or oil platforms.

Without the help from a nimbler and more maneuverable towing vessel, larger ships, such as mega-ships, would not be able to or at least have difficulties getting into a port.

Tugboats may use their propulsion system and/or hydrodynamic characteristics of the hull to generate forces for maneuvering the towed vessel. Tugboats may operate in a direct towing mode or an indirect towing mode. During direct mode operations a towline force on the towing line is produced, due to a pull of the tugboat's propulsion system. Therefore, operations such as stopping or reducing the towed vessel's initial movement, or assisting the towed vessel during steering, is performed by keeping the tugboat either parallel to the vessel's centerline or open to the corresponding side of the towed vessel.

During indirect towing, which may also be referred to as dynamic towing, the tugboat usually trails the towed vessel and exerts forces on the towed vessel for turning and/or decelerating the towed vessel. The tugboat's propulsion system may be used to place and maintain the hull of the tugboat in an angled position in relation to the towed vessel. Thereby, hydrodynamic forces will be created by the vessel's hull acting against the direction of travel of the towed vessel. By positioning the side, such as a starboard or port side, of the tugboat against the direction of travel of the towed vessel the hull of the tugboat will provide a large surface acting against the flow direction of the water thereby generating drag forces which may be transmitted to the towed vessel for turning and/or decelerating the towed vessel. Decelerating and/or steering is controlled by the tug by maintaining a reference angle corresponding to the water flow direction, as opposed to the direction taken by the towed vessel. The port side is the side of the vessel which is to the left of an observer facing the bow, that is, facing forward towards the direction the vessel is heading when underway, and the starboard side is to the right side of such an observer.

A tugboat's towing equipment is a crucial link for transferring forces generated by the tugboat to the towed vessel. The towing equipment may comprise various elements which may vary between different types of tugboats. These elements are in the simplest versions just a towing bitt and towline or a towing hook and towline. The towing equipment may however also comprise a towing winch, a fairlead, the towing line, and/or towing pins. Each element of the towing equipment must be strong enough or designed in such a way that it can cope with the high forces generated in the towing line. Due to the high forces the towing line is typically heavy and strong. A failure of any of the elements in the towing equipment may lead to the towing line suddenly snapping or sweeping over a deck of the tugboat, which may cause injuries to crew members working on the deck of the tugboat.

A further crucial aspect is a location of the towing point, wherein the towing point herein shall be interpreted as a point on the tugboat from where the towing line goes directly to the towed vessel. The towing line may be connected to the tug by the towing hook, the towing winch and/or may be secured to towing bit, which may all be referred to as towing points if they are the point on the tugboat from where the towing line goes directly to the towed vessel. The location of the towing point may vary between different types of tugboats. The danger with towing using a towing line is the risk of girting and capsizing. Girting may happen when the towline comes at right-angles to the tugboat, e.g., during indirect towing when the hull of the tugboat is positioned perpendicular to the towed vessel. If the towing line is secured around amidships of the tugboat and position at a right angle to the tugboat, then the towing line under tension will exert a heeling moment on the tugboat. As with any vessel which heels over to one side, such as the starboard or port side, due to an external force, a righting lever may be formed as a center of buoyancy of the tugboat moves towards a center of the tugboats underwater volume, countering the heeling moment and pushing the tugboat back upright again. However, if the force in the towline is sufficiently powerful, it may overcome the tugboat's righting lever which may lead to deck-edge immersion of water, flooding and capsizing, which may also be referred to as girting, unless the towline is released in good time. Girting may occur very rapidly, and incidents have occurred where crew members have not been able to escape in time.

A known solution for solving the problem of girting is to use a carrousel type tugboat, in which a winch is mounted to a ring bearing arranged around an accommodation building of the tugboat. The towing point is located at the circumference of the ring bearing at a distance from the midship. The winch and thus the towing point may be rotated 360 degrees around the accommodation building using a moveable rail. This solution however has the drawback that it requires a drive system and a lot of moving parts for moving the winch, which makes it expensive and prone to failure.

SUMMARY

Accordingly, there is a need for a towing solution, which mitigate, alleviate or address the shortcomings existing and provides a reliable and cost-effective solution for towing which reduces the risk of failure and injuries amongst crew members.

A hull for a vessel for towing is disclosed. The hull comprises a deck and a towing staple for guiding a towing line. The towing staple comprises a guiding element having a symmetrical extension in a first plane parallel to the deck. The guiding element comprises a first and a second mounting section mounting the guiding element to the hull in a second plane perpendicular to the first plane. The first and second mounting sections are connected by means of a main section of the guiding element, wherein the guiding element comprises a towing line guiding surface located on a bottom side of the main section facing the deck. The towing line guiding surface is configured to, during a towing procedure, slidably contact the towing line, such that the towing line can freely move along a periphery of the main section in the first plane while being restricted in movement by the main section in a direction perpendicular to the first plane. The towing staple further comprises a support element. The support element is arranged on a top side of the main section and extends at an angle to the first plane from the top side of the guiding element to a second plane perpendicular to the first plane and extending through the first and second mounting sections.

Further, a towing staple for a vessel for towing is provided. The towing staple is configured to guide a towing line. The towing staple comprises a guiding element having a symmetrical extension in a first plane. The guiding element comprises a first and a second mounting section for mounting the guiding element to a second plane perpendicular to the first plane, wherein the first and second mounting sections are connected by means of a main section of the guiding element. The guiding element comprises a towing line guiding surface located on a bottom side of the main section. The towing line guiding surface is configured to, during a towing procedure, slidably contact the towing line, such that the towing line can freely move along a periphery of the main section in the first plane while being restricted in movement by the main section in a direction perpendicular to the first plane. The towing staple further comprises a support element, wherein the support element is arranged on a top side of the main section and extends at an angle to the first plane from the top side of the guiding element to the second plane.

It is an advantage of the present disclosure that the towing staple when it is in contact with the towing line acts as a towing point and lowers a position of the towing point in relation to the deck of the vessel for towing and moves it closer to a side of the hull of the vessel for towing. By lowering the towing point the heeling moment created by the towing line force and acting on the hull of the vessel for towing is reduced. Furthermore, by moving the towing point closer to the side of the vessel for towing the heeling lever arm may be reduced while a righting lever arm is increased. The towing staple of the present disclosure thus improves the stability of the vessel for towing, and improves maneuverability, and direct and indirect towing performance of the vessel for towing. By adding a support element to the towing staple, a rigidity of the towing staple is further increased which reduces the risk of the towing staple failing and causing injuries of crew members due to failed guiding of the towing line.

Furthermore, the solution according to the present disclosure does not comprise any movable parts which reduces the cost of the solution and improves reliability of the solution.

The towing staple according to the present disclosure thus improves maneuverability, direct and indirect towing performance, and stability of the vessel for towing, while reducing costs and improving reliability compared to existing towing solutions.

BRIEF DESCRIPTION OF THE DRAWINGS

The above and other features and advantages of the present disclosure will become readily apparent to those skilled in the art by the following detailed description of exemplary embodiments thereof with reference to the attached drawings, in which.

DETAILED DESCRIPTION

Figure 1A:
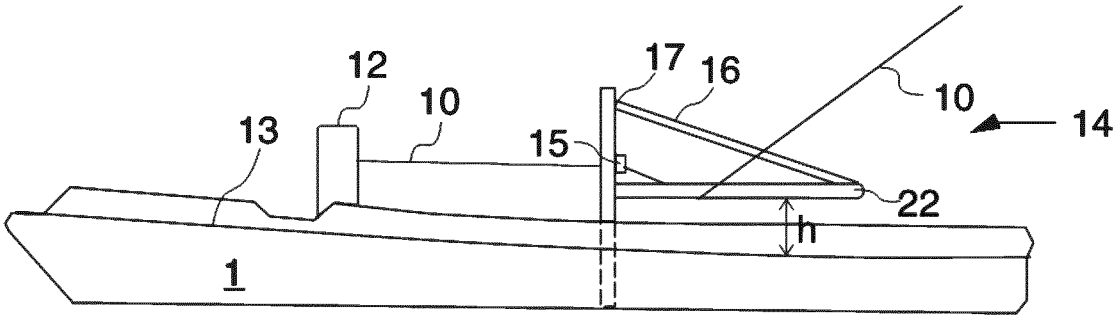
FIG. 1A illustrates a side view of a first exemplary vessel for towing according to this disclosure.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the disclosure or as a limitation on the scope of the disclosure. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The figures are schematic and simplified for clarity, and they merely show details which aid understanding the disclosure, while other details have been left out. Throughout, the same reference numerals are used for identical or corresponding parts.

Figure 1B:
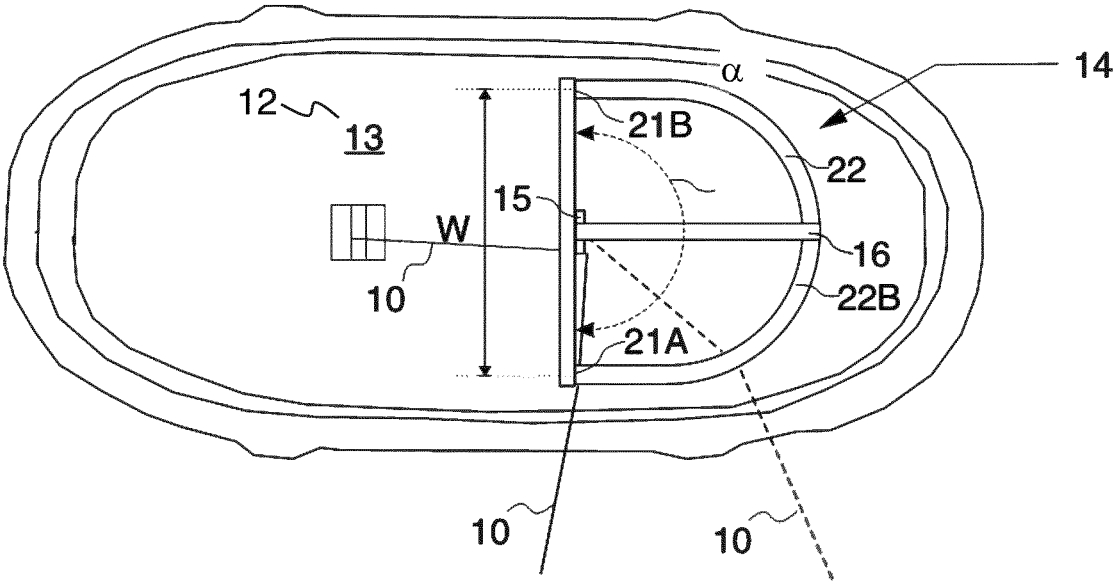
FIG. 1B illustrates a top-down view of the first exemplary vessel for towing according to this disclosure.

FIGS. 1A and 1B illustrate a hull 1 for a vessel for towing, such as a tugboat, according to one or more embodiments herein, seen in a side view in FIG. 1A and a top down view of the hull 1 in FIG. 1B. The hull 1 comprises a deck 13, such as a main deck of the vessel, and a towing staple 14 for guiding a towing line 10. The deck 13 may be a first deck arranged above a waterline of the hull. The towing line 10 may be a towing line arranged on the hull 1 or may be a towing line arranged on a towed vessel. When the towing line 10 is arranged on the hull 1 it may be connected to a winch 12 mounted to the hull 1, which allows the towing line to be extended and retracted by being wound up or unwounded from the winch 12. The winch 12 may be arranged laterally amidships, such as centered on a longitudinal axis of the hull extending from the bow to the stern in the center of the hull 1. The towing staple 14 comprises a guiding element 20 having a symmetrical, or at least essentially symmetrical, extension in a first plane parallel to the deck 13. The first plane may be substantially horizontal, such as having a vertical normal. The guiding element 20 comprises a first and a second mounting section 21A, 21B for mounting the guiding element 14A to the hull 1 in a second plane perpendicular to the first plane. The first and second mounting sections 21A, 21B are connected by means of a main section 22 of the guiding element 20.

The guiding element 20 comprises a towing line guiding surface 23 located on a bottom side of the main section 22, which bottom side is facing the deck 13. The towing line guiding surface 23 is configured to, during a towing procedure, slidably contact the towing line 10, such that the towing line can freely move along a periphery of the main section 22 in the first plane while being restricted in movement by the main section 22 in a direction perpendicular to the first plane.

The towing staple further comprises a support element 16. The support element 16 is arranged on a top side of the main section 22, such as a side of the main section facing in an opposite direction as the guiding surface 23, and extends at an angle to the first plane from the top side of the guiding element 20 to the second plane. The support element 16 is thus able to take up and direct forces from the towing line 10 into the hull 1 of the towing vessel and reduces the bending moment in the towing staple. The support element 16 thus adds rigidity to the towing staple 14 and allows the towing staple to take up higher towing forces without being deformed and/or breaking.

The mounting sections 21A, 21B may be detachably mounted to the hull by fastening means, such as nuts and bolts, or may be fixedly mounted to the hull 1, e.g., by being welded to the hull 1. When the towing staple 14 is welded to the hull 1 it may be an integral part of the hull 1, which has the benefit that the rigidity of the towing staple is increased which reduces the risk of failure of the towing staple 14 during towing. The towing staple 14 may comprise or be mounted to one or more vertically arranged beams for mounting the first and second mounting sections 21A, 21B to the hull 1. The one or more beams may extend in a vertical direction through the hull 1 and may be an integral part of the hull 1.

The hull 1 may comprise a fairlead 15 for guiding the towing line 10. The fairlead 15 may be arranged at the center of the hull 1, such as laterally amidships along the longitudinal center plane of the hull 1. The towing line 10 may be fed from the winch through the fairlead 15 such that the towing line exits the fairlead 15 in an area of the longitudinal center plane of the hull 1. The longitudinal center plane shall herein be interpreted as a plane extending through the center of the hull 1 in a longitudinal direction, such as from the aft to the stern of the hull 1. The longitudinal center plane may thus constitute a symmetry plane of the hull 1 in the longitudinal direction. The towing staple 14 may be arranged on the hull 1 so that the fairlead 15 is arranged along the longitudinal center plane of the towing staple 14. Preferably, the towing staple 14 may be centrally mounted on the hull 1, such that the longitudinal center plane of the hull 1 and the longitudinal center plane of the towing staple 14 may correspond. Thereby, the towing characteristics of the vessel for towing will be equal on a port and on a starboard side of the hull 1. The towing line 10 is then fed between the towing staple 14 and the deck 13 of the hull 1 and at an angle upwards onto the typically much larger towed vessel, such that the towing line 10 is in contact with the towing line guiding surface 23.

The guiding element 20 of the towing staple 14 may be shaped so that the distance from the fairlead to the towing line guiding surface 23 of the guiding element 20 varies over the periphery of the guiding element 20. Thereby, a towing line 10 extending from the fairlead 15 to the guiding element 20 and being in sliding contact with the towing line guiding surface 23 will, during a towing procedure, not rub against the towing staple 14 with the same area of the towing line 10. This reduces the risk of towing line failure since the friction on the towing line is not constantly acting in the same area.

The guiding element 20 of the towing staple 14 may have an arch-shaped form, when seen in the first plane. The arch-shape may be e.g., a U-shape, a semi-circular, semi-elliptical, parabolic, horse-shoe etc. The exemplary guiding element 20 as shown in FIGS. 1A and 1B has a U-shape, when seen in the first plane, such that the main section 22 comprises two parallel sections 22A and a curved section 22B. The end sections of the two parallel sections 22A of the U-shaped guiding element 20 may constitute the mounting sections 21A, 21B for mounting the guiding element 20 to the hull 1, such as to a vertical wall of the hull 1, such as to a transverse bulwark of the hull 1.

The towing staple 14 may span a viewing angle $\alpha$ of at least 140° seen from the fairlead 15 in a direction of a longitudinal centerline of the hull 1. In some embodiments the towing staple 14 may span a viewing angle $\alpha$ of at least 170°, preferably at least 180°. Thereby, the hull 1 of the vessel for towing may be positioned at an angle of 70°-90° to the towed vessel in both port and starboard direction, thereby increasing the drag force created by the hull 1 when using the hydrodynamic forces of the hull as a floating anchor, such as during indirect towing. This improves maneuverability, and direct and indirect towing performance of the vessel for towing.

A width of the guiding element 20, such as the distance between the first and second mounting sections 21A, 21B may be adapted to, such as configured to, move a towing point away from the longitudinal centerline of the hull 1 towards an outer side, such as the port or starboard side, of the hull 1. The towing staple 14 may be arranged within an inner periphery of the hull 1, such that the towing line and/or crew members working on the deck 13 may pass between the towing staple 14 and a side, such as a railing, of the vessel for towing in an undisturbed matter. The actual width W of the guiding element 20 is thus dependent on the dimensions of the hull 1. The width W may be in a range of 20 to 95% of a width of the hull 1 at a corresponding longitudinal position. In some embodiments the width W is at least 2 m, preferably at least 6 m, such as at least 10 m. Increasing the width of the guiding element 20, which corresponds to increasing the distance from the fairlead to the guiding element in either port or starboard direction, increases the lever arm at which an upward force from the towing line 10 connected to the towed vessel acts. Thereby, a righting moment counteracting the girting moment acting on the vessel for towing is increased and thus reduces the risk of the vessel capsizing.

The guiding element 20 of the towing staple 14 may be arranged closer to the deck 13 than the fairlead 15. By arranging the guiding element 20 closer to the deck 13 than the fairlead 15, the towing point will be lowered compared to if the fairlead would constitute the towing point, which would be the case if no towing wing staple would be used. A distance h from the towing line contacting surface 23 of the guiding element 20 of the towing staple 14 to the deck 13, such as in a vertical direction, may be in a range of 10 cm to 200 cm. By reducing the distance h the towing point is lowered, which reduces the lever arm at which the towing line force acts and creates the heeling moment. Thus, by reducing the distance h, the heeling moment acting on the hull 1 during towing is reduced which increases stability of the vessel for towing and reduces the risk for girting and capsizing.

The support element 16 may extend from a top side of the guiding element 20 facing away from the deck 13 to a connection point 17 located further away from the deck than the fairlead 15 in a vertical direction of the hull 1. The support element 16 adds rigidity to the towing staple 14 and reduces a movement of the guiding element in an upwards direction due to the towing forces, which may cause fatiguing and eventual failure of the material of the guiding element 20. The support element 16 may be dimensioned to withstand the maximum towing forces that may be generated on the towing line 10 by the vessel for towing.

Figure 2A:
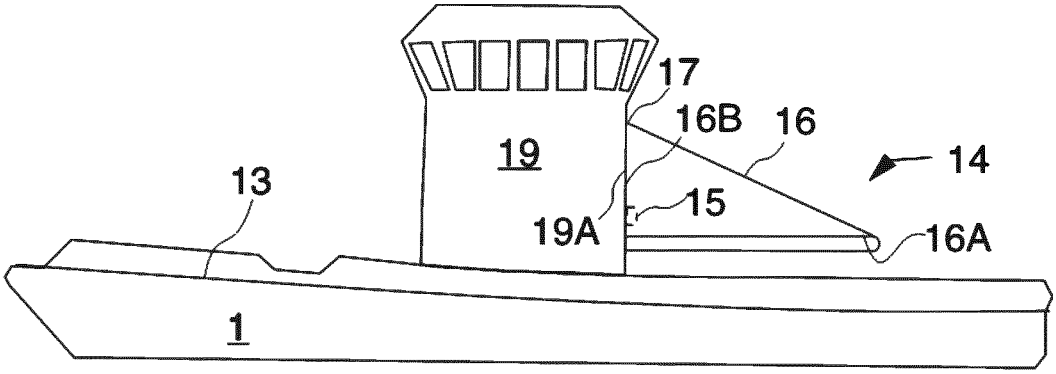
FIG. 2A illustrates a side view of a second exemplary vessel for towing according to this disclosure.
Figure 2B:
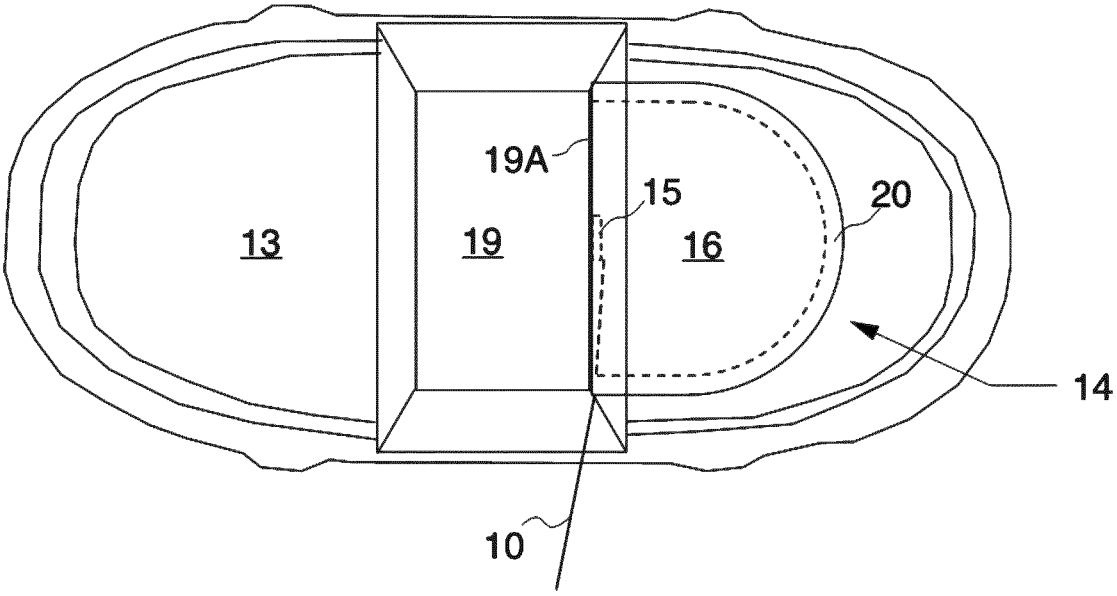
FIG. 2B illustrates a top-down view of the second exemplary vessel for towing according to this disclosure.

FIGS. 2A and 2B illustrate the hull 1 for the vessel for towing according to one or more embodiments herein, seen in a port side view in FIG. 2A and a top-down view of the hull 1 in FIG. 2B. As can be seen in FIGS. 2A and 2B the exemplary support element 16 comprises a sheet material, such as one or more sheet elements, extending from the top side of the guiding element 20 to the connection point 17 on a second plane perpendicular to the first plane, such that the support element 16 creates an enclosure covering the guiding element 20. The hull 1 may further comprise an accommodation building 19, for accommodating personnel on board of the vessel, such as crew members. The second plane may be located on an aft or fore facing wall 19A of the accommodation building 19. The towing line 10 may be routed through the accommodation building 19 and may exit the accommodation building 19 through the fairlead 15 arranged in the fore or aft facing wall 19A. The support element 16 may have a first edge 16A being arranged on and following the circumference of the guiding element 20 along the top side of the guiding element 20. The support element 16 may have a second edge 16B being parallel to the second plane and mounted to the hull 1 at the second plane, such as to the fore or aft facing wall 19A. The support element 16 thus creates an enclosure, such as a roof, covering the guiding element 20. The enclosure may have the shape of a dome or a cone, extending at an angle from the guiding element 20 to and/or towards the second plane. By enclosing the top side of the guiding element, a cone or dome shape box construction is created which increases the rigidity of the towing staple 14. The enclosure further reduces the risk of a line thrown from a vessel to be towed onto a vessel for towing, such as a towing line or a messenger line, entering the towing staple from the top, in which case the towing line would not contact the towing line contacting surface 23, and/or gets entangled and caught in protruding objects located on the deck 13 of the vessel for towing. The sheet material, such as the one or more sheet elements, provides a smooth surface on top of the towing staple 14. The smooth surface allows the line to slide of the towing staple and onto the deck of the vessel for towing, from where the line can be manually or automatically connected to the towing line 10 and pulled onto the vessel to be towed from underneath the towing staple. The inclination and the smooth outer surface of the support element 16 prevents the line thrown from the towed vessel to get caught in obstacles on the deck of the vessel for towing. The enclosure may also act as cover or shelter for crew members working on the deck of the vessel for towing, which reduces the risk of crew members being hit by a thrown line and being injured.

Figure 3A:
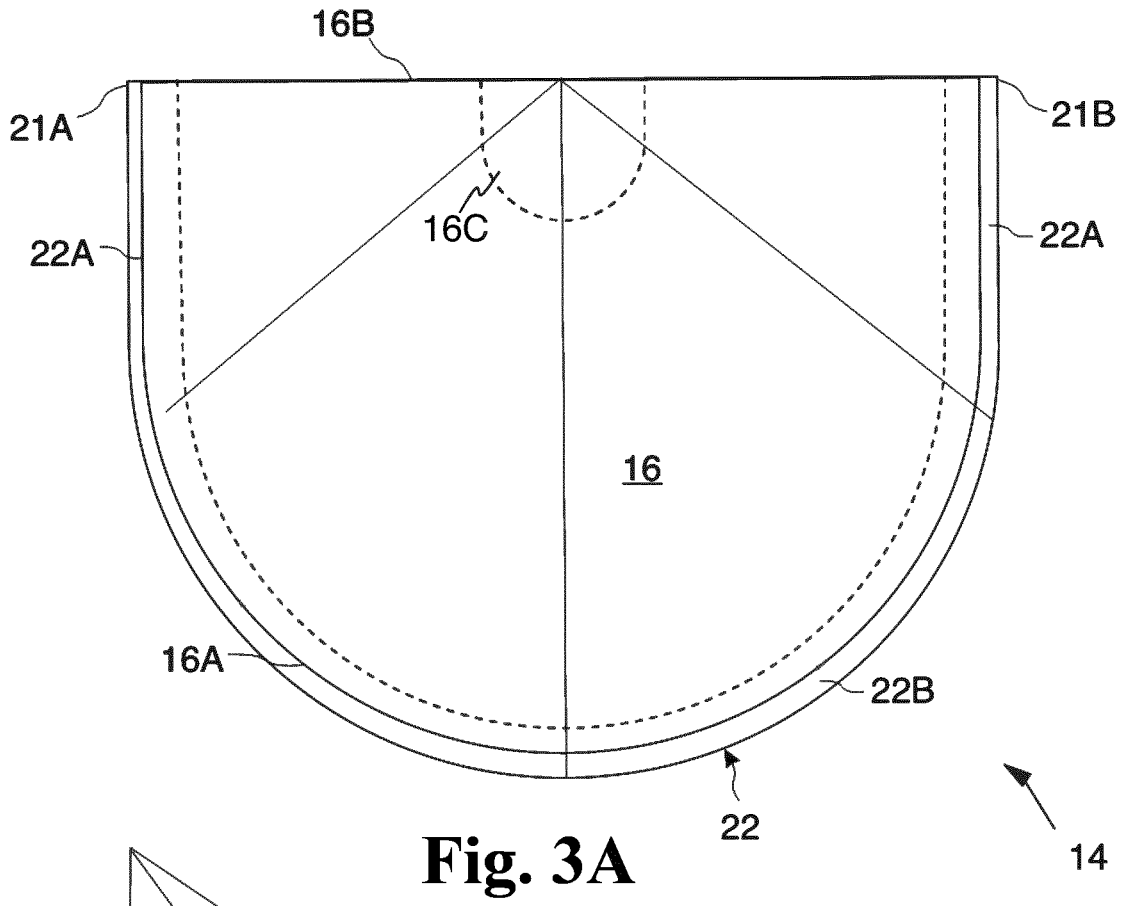
FIG. 3A illustrates a top-down view of an exemplary towing staple according to this disclosure.
Figure 3B:
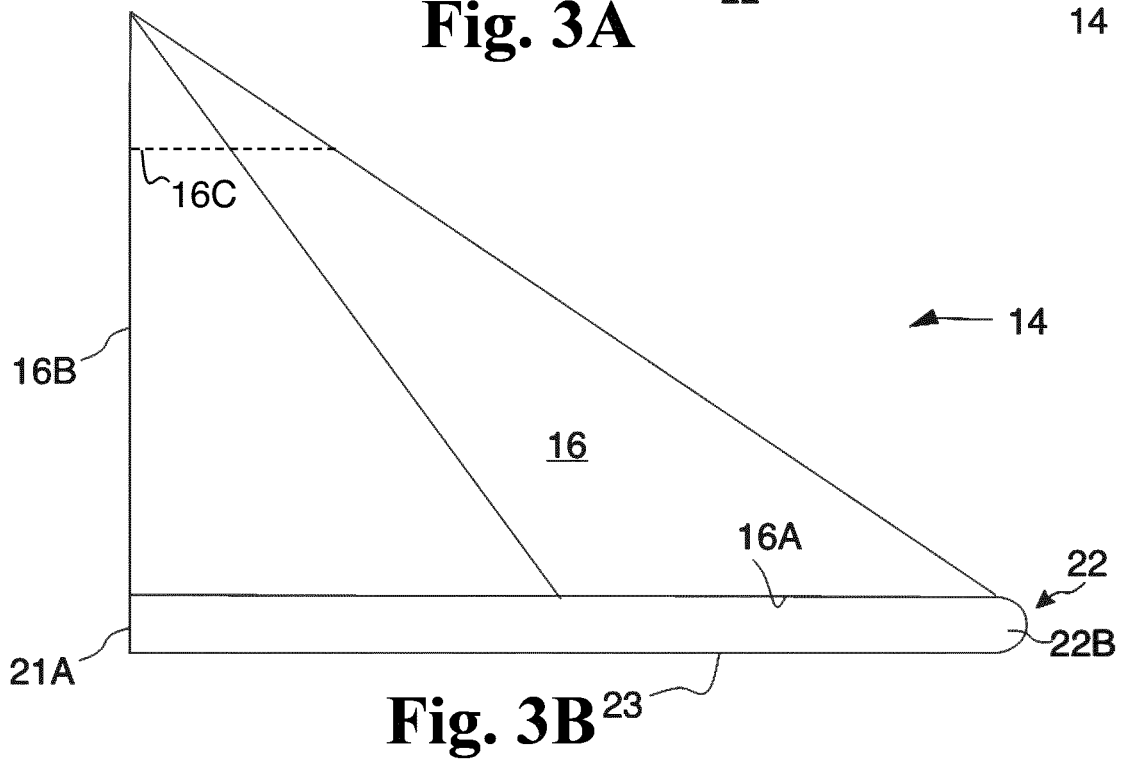
FIG. 3B illustrates a side view of the exemplary towing staple according to this disclosure.

FIGS. 3A and 3B show a towing staple 14 for the vessel for towing from a top-down view in FIG. 3A and a side view in FIG. 3B. The towing staple is configured to guide a towing line, such as during a towing procedure. The towing staple 14 comprises the guiding element 20 and a support element 16. The guiding element 20 has a symmetrical extension in a first plane, wherein the first plane is a substantially horizontal plane when the towing staple is mounted to the hull of vessel. The guiding element 20 comprises a first and a second mounting section 21A, 21B for mounting the guiding element 20 to a second plane perpendicular to the first plane. The second plane may e.g., be a vertical wall of a hull of a vessel. The first and second mounting sections 21A, 21B are connected by means of a main section 22 of the guiding element 20. The guiding element 20 comprises a towing line guiding surface 23 located on a bottom side of the main section 22, wherein the towing line guiding surface 23 is configured to, during a towing procedure, slidably contact the towing line. The towing line can thus freely move along a periphery of the main section 22 in the first plane while being restricted in movement by the main section 22 in a direction perpendicular to the first plane. The towing line guiding surface 23 may extend uninterrupted along the entire circumference of the guiding element. Extending uninterrupted shall herein be interpreted as extending from the first mounting section 21A to the second mounting section 21B along the main section 22 of the guiding element 20. The towing line guiding surface 23 comprising e.g., openings for a lubrication system does however not contradict the towing line guiding surface 23 extending uninterrupted. In order to reduce friction on the towing line the towing line guiding surface 23 may be coated with a friction reduction coating.

The support element 16 is arranged on a top side of the main section 22 of the guiding element 20 and extends at an angle to the first plane from the top side of the guiding element 20 to the second plane. The support element 16 may have a base end 16A and a top end 16B, wherein the base end 16A is arranged on the guiding element 20 and the top end 16B is configured for being mounted to a mounting area located in a second plane. The second plane may be perpendicular to the first plane. The second plane may for example extend through the first and second mounting sections 21A, 21B of the guiding element 20. The support element 16 is configured to counteract forces induced on the towing line contacting surface 23 of the guiding element 20 by the towing line 10. Forces applied to the guiding element 20 may thus be distributed from the point of contact of the towing line 10 through the support element 16 into a mounting structure, such as the hull of the vessel for towing, to which the towing staple may be attached.

The guiding element 20 may have an arch-shaped form, when seen in the first plane. The arch-shaped form shall herein be interpreted as having a first and a second section being arranged at a distance and parallel to each other, and the first and the second sections being connected by one or more curved sections. The arch-shaped form provides the towing staple with a symmetrical shape thereby providing corresponding contacting points for the towing line on both sides of a centerline of the arch-shaped form. Thereby, the hull will have the same stability and towing performance during a towing procedure regardless of which side of the tugboat the towed vessel is located at. Furthermore, by adjusting properties of the arch-shaped form, such as dimensions and/or shape, wear of the towing line may be reduced. The arch-shape may be e.g., a U-shape, a semi-circular, semi-elliptical, parabolic, horse-shoe etc. In the exemplary embodiment shown in FIG. 4, the guiding element 20 has a U-shape, when seen in the first plane, such that the main section 22 comprises two parallel sections 22A and a curved section 22B, wherein the end sections of the two parallel sections 22A of the U-shaped guiding element 20 constitute the mounting sections 21A, 21B. The shape and dimensions of the guiding element 20 may be configured such that the distance from an intersection of the first and second plane, which intersection may be a position of a towing point when the towing staple 14 is mounted to the hull 1, to a position on the guiding surface 23 varies over the circumference of the guiding element 20. By having the distance from the intersection to the towing line guiding surface vary over the circumference of the guiding element 20 a contact point of the towing line 10 on the guiding element 20 will not constantly rub against the same spot on the towing line when the towing line moves along the periphery of the guiding element 20, for example from a port to a starboard side of the guiding element 20, thereby reducing the risk of tow line failure.

In the exemplary towing staple 14 shown in FIGS. 3A and 3B, the support element 16 comprises a sheet material extending from the top side of the guiding element 20 to and/or towards the second plane, such that the support element 16 creates an enclosure, such as a roof, covering the guiding element 20. The enclosure may have the shape of a dome or a cone, extending at an angle from the guiding element 20 to and/or towards the second plane. In other words, the support element may be arranged with an inclination to the first plane and/or the second plane. By enclosing the top side of the guiding element 20 a box shape is created which increases the rigidity of the towing staple 14. The enclosure reduces the risk of a line thrown from a vessel to be towed onto a vessel for towing, such as a towing line or a messenger line, does not enter the towing staple from the top, such that it does not contact the towing line contacting surface 23, and/or gets entangled and caught in protruding objects located on a deck of the vessel for towing. The sheet material provides a smooth surface on top of the towing staple 14, the smooth surface allowing the line to slide of the towing staple and onto the deck of the vessel for towing, from where the line can be manually or automatically connected to the towing line 10 and pulled onto the vessel to be towed from underneath the towing staple. The enclosure of the towing staple 14 prevents a line thrown from the towed vessel to get caught in obstacles on the deck of the vessel for towing. The enclosure may also act as cover or shelter for crew members working on the deck of the vessel for towing, which reduces the risk of crew members being hit by the line thrown from the towed vessel and being injured.

The sheet material of the support element 16 may have a first edge 16A being arranged on and following the circumference of the guiding element 20 along the top side of the guiding element 20, and a second edge 16B being parallel to the second plane. The second edge 16B may act as a mounting area for mounting the towing staple 14 to the hull of a vessel. The towing staple 14 may for example be welded to the hull along the second edge 16B, such that a rigid connection is created between the hull and the second edge 16B of the support element. By increasing an attachment surface between the hull 1 and the support element 16, the rigidity of the towing staple can be improved. By enclosing the guiding element 20 the rigidity of and force distribution from the guiding element 20 may be further increased, since the support element 16 abuts a majority of the circumference of the guiding element 20 and not only on one small area of the guiding element 20. In some embodiments the support element 16 may be shaped as a truncated cone, such that the support element 16 comprises a horizontal section 16C arranged at a distance from the guiding element 20 and in parallel to the first plane. An inclined section of the support element 16 may thus extend from the guiding element 20 to the horizontal section 16C of the support element 16. The horizontal section 16C may follow the shape of the guiding element 20 but may be smaller in dimensions.

The guiding element 20 and the support element 16 may be made out of metal, such as any material suitable for marine use, such as steel, stainless steel, aluminium, or similar.

Figure 4:
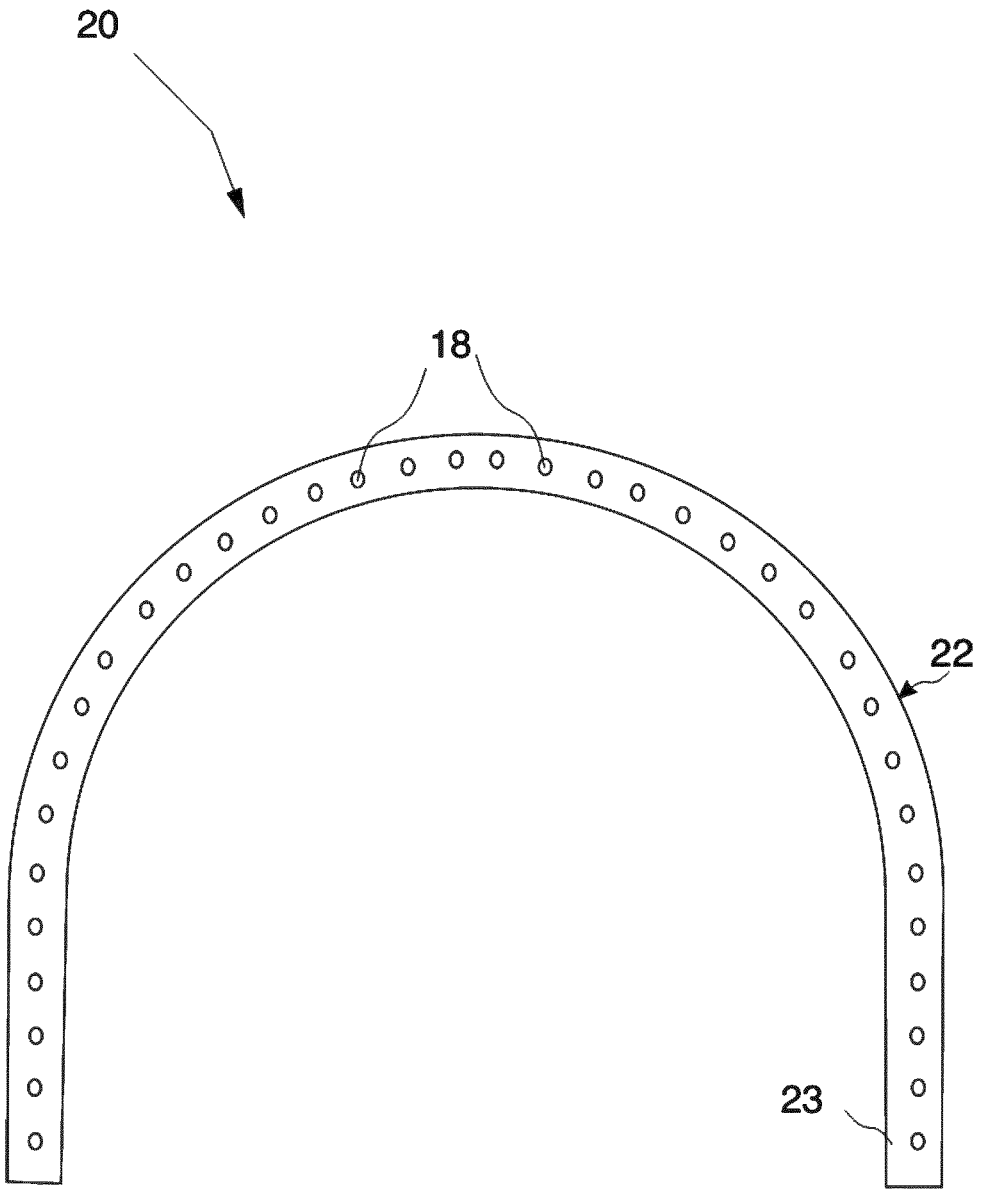
FIG. 4 illustrates an exemplary towing staple comprising a lubrication system according to this disclosure.

FIG. 4 shows the towing staple seen from a towing line facing surface 23 according to some embodiments herein. In order to further reduce friction of the towing line 10, the guiding element 20 may comprise a lubrication system for lubricating the towing line during a towing procedure. The lubrication system may comprise a plurality of openings 18 in the towing line guiding surface 23 of the guiding element 20 and a lubricant feeding system for feeding a lubricant through the plurality of openings 18 onto the towing line 10 to reduce the friction between the towing line and the towing line guiding surface. The lubricant may for example be water, such as sea water. The lubricant feeding system may further comprise a pump for feeding the lubricant onto the towing line. The solution having a plurality of openings has the benefit that the solution is cost effective and reliable since this solution does not comprise any moving parts.

In some embodiments a lubricant comprising an additive having friction reducing characteristics may be used. The lubricant may be fed from a tank located on the vessel for towing. In some embodiments, the lubrication system may comprise one or more nozzles for injecting lubricant (not shown in FIG. 4), wherein the nozzles may be arranged in the towing line guiding surface 23 of the guiding element 20 and directed such that the nozzles spray lubricant onto the towing line 10. Providing the lubrication system with nozzles has the benefit that the amount of lubrication fed to the towing line can be controlled and directed only to areas of the guiding element 20 where the towing line is contacting the guiding element, which may reduce waste of the lubricant. In order to further reduce waste of the lubricant and to prevent lubricant from ending up in the sea a lubricant collection and recirculation system may be comprised in the lubrication system. The lubricant collection and recirculation system may comprise a collector arranged underneath the towing line guiding surface 23, such as in the hull 1 of the vessel for towing, for collecting excess lubricant. An additional pump may be connected to the collector and may feed the collected lubricant back into the tank.

It shall be noted that the features mentioned in the embodiments described in FIGS. 1-4 are not restricted to these specific embodiments. Any features relating to the towing staple 14 and the components comprised therein and mentioned in relation to the hull 1 shown in FIG. 1A-2B, such as dimensions of the towing staple 14, are thus also applicable to the towing staple 14 described in relation to FIGS. 3-4.

It shall further be noted that a vertical axis, when referred to herein, relates to an imaginary line running vertically through the ship and through its center of gravity, a transverse axis or lateral axis is an imaginary line running horizontally across the ship and through the center of gravity and a longitudinal axis is an imaginary line running horizontally through the length of the ship through its center of gravity and parallel to a waterline. Similarly, when referred to herein, a vertical plane relates to an imaginary plane running vertically through the width of the ship, a transverse plane or lateral plane is an imaginary plane running horizontally across the ship and a longitudinal plane is an imaginary plane running vertically through the length of the ship.

Embodiments of products (hull for a vessel for towing, and towing staple) according to the disclosure are set out in the following items:

Item 1: A hull (1) for a vessel for towing, comprising a deck (13); and a towing staple (14) for guiding a towing line (10), wherein the towing staple (14) comprises:

a guiding element (20) having a symmetrical extension in a first plane parallel to the deck (13), wherein the guiding element (20) comprises a first and a second mounting section (21A, 21B) mounting the guiding element (20) to the hull (1), wherein the first and second mounting sections (21A, 21B) are connected by means of a main section (22) of the guiding element (20), wherein the guiding element (20) comprises a towing line guiding surface (23) located on a bottom side of the main section (22) facing the deck (13), the towing line guiding surface (23) being configured to, during a towing procedure, slidably contact the towing line (10), such that the towing line can freely move along a periphery of the main section (22) in the first plane while being restricted in movement by the main section (22) in a direction perpendicular to the first plane, and a support element (16), wherein the support element (16) is arranged on a top side of the main section (22) and extends at an angle to the first plane from the top side of the guiding element (20) to a second plane perpendicular to the first plane and extending through the first and second mounting sections (21A, 21B).

Item 2: The hull (1) according to Item 1, wherein the guiding element (20) of the towing staple (14) has an arch-shaped form, when seen in the first plane.

Item 3: The hull (1) according to Item 1 or 2, wherein the guiding element (20) has a U-shape, when seen in the first plane, such that the main section (22) comprises two parallel sections (22A) and a curved section (22B), wherein the end sections of the two parallel sections (22A) of the U-shaped guiding element (20) constitute the mounting sections (21A, 21B).

Item 4: The hull (1) according to Item 1 to 3, the hull (1) further comprising a fairlead (15) for guiding the towing line (10), wherein the fairlead (15) is arranged at a longitudinal center plane of the towing staple (14).

Item 5: The hull (1) according to Item 4, wherein the guiding element is shaped so that the distance from the fairlead to the towing line guiding surface (23) of the guiding element (20) varies over the periphery of the guiding element (20).

Item 6: The hull (1) according to any one of the Items 4 or 5, wherein the towing staple (14) spans a viewing angle ($\alpha$) of at least 140° seen from the fairlead (15) in a direction of a longitudinal centerline of the hull (1).

Item 7: The hull (1) according to any one of the Items 4 to 6, wherein the support element (16) extends from a top side of the towing staple (14) facing away from the deck (13) to a connection point (17) located further away from the deck than the fairlead (15) in a vertical direction of the hull (1).

Item 8: The hull (1) according to any one of the Items 1 to 7, wherein the towing staple (14) is arranged within an inner periphery of the hull (1).

Item 9: The hull according to any one of the Items 1 to 8, wherein a width (W) of the guiding element (20) between the first mounting section (21A) and the second mounting sections (21B) is adapted to move a towing point away from the longitudinal centerline of the hull (1) towards an outer side of the hull (1).

Item 10: The hull (1) according to any one of the previous Items, wherein a distance from the towing staple (14) to the deck (13) is in a range of 10 cm to 200 cm.

Item 11: The hull (1) according to any of the previous Items, wherein the support element (16) comprises a sheet material extending from the top side of the guiding element (20) to the second plane, such that the support element (16) creates an enclosure covering the guiding element (20).

Item 12: The hull (1) according to Item 11, wherein the support element (16) has a first edge (16A) being arranged on and following the circumference of the guiding element (20) along the top side of the guiding element (20), and a second edge (16B) being parallel to the second plane and mounted to the hull at the second plane.

Item 13: The hull (1) according to any of the previous Items, wherein the guiding element (20) comprises a lubrication system for lubricating the towing line during a towing procedure.

Item 14: The hull (1) according to Item 13, wherein the lubrication system comprises a plurality of openings (18) in the towing line guiding surface (23) of the guiding element (20) and a lubricant feeding system for feeding lubricant through the plurality of openings (18) onto the towing line (10).

Item 15: The hull (1) according to any one of the previous Items, wherein the hull (1) further comprises an accommodation building (19), and wherein the second plane is located on an aft or fore facing wall (19A) of the accommodation building (19).

Item 16: The hull (1) according to any one of the previous Items, wherein the towing staple (14) is an integral part of the hull (1).

Item 17: A towing staple (14) for a vessel for towing, wherein the towing staple is configured to guide a towing line, the towing staple (14) comprising:

a guiding element (20) having a symmetrical extension in a first plane, wherein the guiding element (20) comprises a first and a second mounting section (21A, 21B) for mounting the guiding element (20) to a hull of the vessel for towing, wherein the first and second mounting sections (21A, 21B) are connected by means of a main section (22) of the guiding element (20), wherein the guiding element (20) comprises a towing line guiding surface (23) located on a bottom side of the main section (22), the towing line guiding surface (23) being configured to, during a towing procedure, slidably contact the towing line (10), such that the towing line can freely move along a periphery of the main section (22) in the first plane while being restricted in movement by the main section (22) in a direction perpendicular to the first plane, and a support element (16), wherein the support element (16) is arranged on a top side of the main section (22) and extends at an angle to the first plane from the top side of the guiding element (20) to a second plane perpendicular to the first plane and extending through the first and second mounting sections (21A, 21B).

Item 18: The towing staple according to Item 17, wherein the guiding element (20) of the towing staple (14) has an arch-shaped form, when seen in the first plane.

Item 19: The towing staple (14) according to Item 17 or 18, wherein the guiding element (20) has a U-shape, when seen in the first plane, such that the main section (22) comprises two parallel sections (22A) and a curved section (22B), wherein the end sections of the two parallel sections (22A) of the U-shaped guiding element (20) constitute the mounting sections (21A, 21B).

Item 20: The towing staple (14) according to any one of the Items 17 to 19, wherein the support element (16) has a base end (16A) and a top end (16B), wherein the base end (16A) is arranged on the guiding element (20) and the top end (16B) is configured for being mounted to a mounting area located in the second plane.

Item 21: The towing staple (14) according to any of the Items 17 to 20, wherein the support element (16) comprises a sheet material extending from the top side of the guiding element (20) to the second plane, such that the support element (16) creates an enclosure covering the guiding element (20).

Item 22: The towing staple (14) according to Item 21, wherein the support element (16) has a first edge (16A) being arranged on and following the circumference of the guiding element (20) along the top side of the guiding element (20), and a second edge (16B) being parallel to the second plane.

Item 23: The towing staple (14) according to any one of the Items 17 to 22, wherein the guiding element (20) comprises a lubrication system for lubricating the towing line during a towing procedure.

Item 24: The towing staple (14) according to Item 23, wherein the lubrication system comprises a plurality of openings (18) in the towing line guiding surface (23) of the guiding element (20) and a lubricant feeding system for feeding lubricant through the plurality of openings (18) onto the towing line (10).

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering. Furthermore, the labelling of a first element does not imply the presence of a second element and vice versa.

It is to be noted that the word "comprising" does not necessarily exclude the presence of other elements or steps than those listed.

It is to be noted that the words "a" or "an" preceding an element do not exclude the presence of a plurality of such elements.

Although features have been shown and described, it will be understood that they are not intended to limit the claimed disclosure, and it will be made obvious to those skilled in the art that various changes and modifications may be made without departing from the scope of the claimed disclosure. The specification and drawings are, accordingly, to be regarded in an illustrative rather than restrictive sense. The claimed disclosure is intended to cover all alternatives, modifications, and equivalents.

What is claimed is:

1. A hull for a vessel for towing, comprising a deck; and a towing staple for guiding a towing line, wherein the towing staple comprises:

a guiding element having a symmetrical extension in a first plane parallel to the deck, wherein the guiding element comprises a first and a second mounting section mounting the guiding element to the hull, wherein the first and second mounting sections are connected by means of a main section of the guiding element, wherein the guiding element comprises a towing line guiding surface located on a bottom side of the main section facing the deck, the towing line guiding surface being configured to, during a towing procedure, slidably contact the towing line, such that the towing line can freely move along a periphery of the main section in the first plane while being restricted in movement by the main section in a direction perpendicular to the first plane, and a support element, wherein the support element is arranged on a top side of the main section and extends at an angle to the first plane from the top side of the guiding element to a second plane perpendicular to the first plane and extending through the first and second mounting sections.

2. The hull according to claim 1, wherein the guiding element of the towing staple has an arch-shaped form, when seen in the first plane.

3. The hull according to claim 1, wherein the guiding element has a U-shape, when seen in the first plane, such that the main section comprises two parallel sections and a curved section, wherein end sections of the two parallel sections of the U-shaped guiding element constitute the mounting sections.

4. The hull according to claim 1, the hull further comprising a fairlead for guiding the towing line, wherein the fairlead is arranged at a longitudinal center plane of the towing staple.

5. The hull according to claim 4, wherein the guiding element is shaped so that a distance from the fairlead to the towing line guiding surface of the guiding element varies over the periphery of the guiding element.

6. The hull according to claim 4, wherein the towing staple spans a viewing angle ($\alpha$) of at least 140° seen from the fairlead in a direction of a longitudinal centerline of the hull.

7. The hull according to claim 4, wherein the support element extends from a top side of the towing staple facing away from the deck to a connection point located further away from the deck than the fairlead in a vertical direction of the hull.

8. The hull according to claim 1, wherein the towing staple is arranged within an inner periphery of the hull.

9. The hull according to claim 1, wherein a width (W) of the guiding element between the first and second mounting sections is adapted to move a towing point away from a longitudinal centerline of the hull towards an outer side of the hull.

10. The hull according to claim 1, wherein a distance from the towing staple to the deck is in a range of 10 cm to 200 cm.

11. The hull according to claim 1, wherein the support element comprises a sheet material extending from the top side of the guiding element to the second plane, such that the support element creates an enclosure covering the guiding element.

12. The hull according to claim 11, wherein the support element has a first edge being arranged on and following a circumference of the guiding element along the top side of the guiding element, and a second edge being parallel to the second plane and mounted to the hull at the second plane.

13. The hull according to claim 1, wherein the guiding element comprises a lubrication system for lubricating the towing line during a towing procedure.

14. The hull according to claim 13, wherein the lubrication system comprises a plurality of openings in the towing line guiding surface of the guiding element and a lubricant feeding system for feeding lubricant through the plurality of openings onto the towing line.

15. The hull according to claim 1, wherein the hull comprises an accommodation building, and wherein the second plane is located on an aft or fore facing wall of the accommodation building.

16. The hull according to claim 1, wherein the towing staple is an integral part of the hull.

17. A towing staple for a vessel for towing, wherein the towing staple is configured to guide a towing line, the towing staple comprising:

a guiding element having a symmetrical extension in a first plane, wherein the guiding element comprises a first and a second mounting section for mounting the guiding element to a hull of the vessel for towing, wherein the first and second mounting sections are connected by means of a main section of the guiding element, wherein the guiding element comprises a towing line guiding surface located on a bottom side of the main section, the towing line guiding surface being configured to, during a towing procedure, slidably contact the towing line, such that the towing line can freely move along a periphery of the main section in the first plane while being restricted in movement by the main section in a direction perpendicular to the first plane, and a support element, wherein the support element is arranged on a top side of the main section and extends at an angle to the first plane from the top side of the guiding element to a second plane perpendicular to the first plane and extending through the first and second mounting sections.

18. The towing staple according to claim 17, wherein the guiding element of the towing staple has an arch-shaped form, when seen in the first plane.

19. The towing staple according to claim 17, wherein the guiding element has a U-shape, when seen in the first plane, such that the main section comprises two parallel sections and a curved section, wherein end sections of the two parallel sections of the U-shaped guiding element constitute the mounting sections.

20. The towing staple according to claim 17, wherein the support element has a base end and a top end, wherein the base end is arranged on the guiding element and the top end is configured for being mounted to a mounting area located in the second plane.

21. The towing staple according to claim 17, wherein the support element comprises a sheet material extending from the top side of the guiding element to the second plane, such that the support element creates an enclosure covering the guiding element.

22. The towing staple according to claim 21, wherein the support element has a first edge being arranged on and following a circumference of the guiding element along the top side of the guiding element, and a second edge being parallel to the second plane.

23. The towing staple according to claim 17, wherein the guiding element comprises a lubrication system for lubricating the towing line during a towing procedure.

24. The towing staple according to claim 23, wherein the lubrication system comprises a plurality of openings in the towing line guiding surface of the guiding element and a lubricant feeding system for feeding lubricant through the plurality of openings onto the towing line.

* * * * *